US007455379B2

(12) United States Patent
Otsuka et al.

(10) Patent No.: US 7,455,379 B2
(45) Date of Patent: Nov. 25, 2008

(54) BIDIRECTIONAL PRINTING METHOD AND APPARATUS WITH REDUCED COLOR UNEVENNESS

(75) Inventors: Naoji Otsuka, Yokohama (JP); Hitoshi Nishikori, Tokyo (JP); Osamu Iwasaki, Tokyo (JP); Toshiyuki Chikuma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 11/537,045

(22) Filed: Sep. 29, 2006

(65) Prior Publication Data

US 2007/0019022 A1 Jan. 25, 2007

Related U.S. Application Data

(62) Division of application No. 11/119,705, filed on May 3, 2005, now Pat. No. 7,131,713, which is a division of application No. 10/941,827, filed on Sep. 16, 2004, now Pat. No. 7,011,391, which is a division of application No. 09/768,464, filed on Jan. 25, 2001, now Pat. No. 6,899,413.

(30) Foreign Application Priority Data

Jan. 25, 2000 (JP) ..... 015677/2000

(51) Int. Cl.
*B41J 2/205* (2006.01)

(52) U.S. Cl. ..... 347/15; 358/523

(58) Field of Classification Search ..... 347/15, 347/9, 43, 41; 358/1.2, 1.9, 523, 1.16, 1.17
See application file for complete search history.

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,528,576 A 7/1985 Koumura et al.
4,558,333 A 12/1985 Sugitani et al.
4,593,295 A 6/1986 Matsufuji et al.
4,661,003 A 4/1987 Okamori
4,723,129 A 2/1988 Endo et al.
4,740,796 A 4/1988 Endo et al.

(Continued)

FOREIGN PATENT DOCUMENTS

EP 0 300 743 1/1989

(Continued)

*Primary Examiner*—Lamson D Nguyen
(74) *Attorney, Agent, or Firm*—Fitzpatrick, Cella, Harper & Scinto

(57) ABSTRACT

A printing apparatus, which forms a color image by applying different color inks to a printing material while bi-directionally moving the recording head to scan the recording material, includes a changing unit for changing an order of applications of the inks of different colors to be applied at least at one amount for printing a secondary color to a secondary color pixel area; and a forming unit for forming the secondary color while making the order of applications of the inks to at least one of a plurality of the secondary color pixel areas arranged along a predetermined direction different from the order of another, by the changing unit.

4 Claims, 11 Drawing Sheets

U.S. PATENT DOCUMENTS

| | | | | |
|---|---|---|---|---|
| 5,225,849 | A | 7/1993 | Suzuki et al. | |
| 5,501,535 | A | 3/1996 | Hastings et al. | 400/88 |
| 5,640,183 | A | 6/1997 | Hackleman | 347/40 |
| 5,754,198 | A | 5/1998 | Nishikawa | |
| 5,907,332 | A | 5/1999 | Fujita et al. | 347/15 |
| 5,920,681 | A * | 7/1999 | Hori | 358/1.5 |
| 5,975,678 | A * | 11/1999 | Kanematsu et al. | 347/43 |
| 6,086,181 | A | 7/2000 | Majette et al. | 347/16 |
| 6,183,055 | B1 * | 2/2001 | Kanematsu et al. | 347/9 |
| 6,254,217 | B1 | 7/2001 | Askeland et al. | 347/43 |
| 6,273,550 | B1 | 8/2001 | Brown | |
| 6,302,508 | B1 | 10/2001 | Asauchi et al. | |
| 6,382,765 | B1 | 5/2002 | Kanda et al. | |
| 6,896,356 | B1 | 5/2005 | Otsuka et al. | |
| 6,905,190 | B1 | 6/2005 | Otsuka et al. | |
| 7,032,991 | B1 | 4/2006 | Otsuka et al. | |

FOREIGN PATENT DOCUMENTS

| | | | |
|---|---|---|---|
| EP | 0 646 460 | 4/1995 | |
| EP | 0 737 001 | 10/1996 | |
| EP | 0 863 479 | 9/1998 | |
| EP | 0 911 174 | 4/1999 | |
| EP | 0 931 664 | 7/1999 | |
| EP | 0 955 174 | 11/1999 | 347/43 |
| EP | 1 072 421 | 1/2001 | |
| JP | 54-56847 | 5/1979 | |
| JP | 59-123670 | 7/1984 | |
| JP | 59-138461 | 8/1984 | |
| JP | 60-71260 | 4/1985 | |
| JP | 2-41421 | 9/1990 | |
| JP | 3-77066 | 4/1991 | |
| JP | 7-112534 | 5/1995 | |

* cited by examiner

BIDIRECTIONAL PRINTING METHOD AND APPARATUS WITH REDUCED COLOR UNEVENNESS

This application is a division of application Ser. No. 11/119,705, filed May 3, 2005, which is a division of application Ser. No. 10/941,827 filed Sep. 16, 2004, which is a division of application Ser. No. 09/768,464 filed Jan. 25, 2001, the entire contents of which are incorporated herein by reference.

FIELD OF THE INVENTION AND RELATED ART

The present invention relates to a bi-directional printing apparatus and a bi-directional printing method for effecting color printing by scanning bi-directionally a printing material with a recording head for applying a plurality of (different) color inks at different ink amounts to the printing material, and more particularly to a bi-directional printing apparatus, a bi-directional printing method and a print wherein color non-uniformity attributable to the bi-directional color print operation is prevented.

In the field of a printing apparatus, particularly an ink-jet type printing apparatus, increase of a recording speed for a color print is desired. To meet this desire, increase of the length of the recording head, increase of the frequency of actuation of the recording head, and bi-directional printing are generally considered. Bi-directional printing is advantageous in that required energy is less concentrated than in unidirectional printing and is scattered in terms of time under the same throughput, and therefore, it is advantageous as to the cost of the total system.

However, the bi-directional printing type is disadvantageous in that it involves an essential problem in that the order of deposition, application or shot of the inks of different colors is different between the forward direction of the main-scanning and the backward direction thereof, depending on the structure of the recording head, and therefore, color non-uniformity in the form of bands results. The problem arises from the order of the ink applications, and therefore, a difference in the coloring more or less appears when different color dots are overlaid with each other even slightly.

When an image is formed by ejecting coloring materials such as pigment or dye ink onto a printing material, the ink first applied first dyes the printing material from the surface layer to the inside of the printing material. When a subsequent dot ink is applied in the manner that it at least partly overlaps with the prior ink dot, the subsequent ink dyes more at a portion below the already dyed portion, and therefore, there is a tendency that the resultant color has a first-color-rich nature. On the other hand, in the case that ejection nozzles for different colors are arranged in the main scan direction, the order of ink shots in the forward scanning operation is opposite from the order of the ink shots in the backward scanning operation. Therefore, the band color non-uniformity occurs due to the difference in the coloring.

The phenomenon occurs similarly in the case of wax type coloring material when a process color is formed due to the time difference, although the printing principles are different.

In the ink jet printer supporting the print, the problem is avoided using the following methods:

1) accept the color non-uniformity; or, only black (Bk) is printed bi-directionally;

2) the nozzles for different colors are arranged in the sub-scan direction (so-called vertical arrangement);

3) use is made of nozzles for forward path and nozzles for backward path, and the different nozzles or heads are used in the forward path and the backward path so that order of shots are the same; or 4) the printing is effected such that rasters to be printed during the forward path and the backward path are interlaced, by which the frequency of the color non-uniformity due to the difference in the order of the shots is increased to provide visual uniformity (Japanese Patent Application Publication Hei 2-41421, Japanese Laid-open Patent Application Hei 7-112534).

When such methods are used, dots of different diameters can be placed in the image, so that an image of less granularity is perfected by relatively smaller droplets, and a wide area is printed with relatively larger droplets with a smaller number of droplets, thus accomplishing high speed and high quality printing.

For this, two kinds of methods have been widely proposed. More particularly, in a printing apparatus provided with a recording head capable of ejecting at least two sizes of liquid, that is, relatively larger droplets and relatively smaller droplets, A) the printing is carried out with single size droplets selected in accordance with a resolution or the like, B) different (at least two) droplet sizes of dots are mixed in accordance with the tone gradation data.

However, the conventional technique 1) does not provide a fundamental solution, and the throughput is significantly lower when a color image is printed. In conventional technique 2), the shot orders are the same in the forward path and the backward path, but the length of the recording head is large, and another difference in the coloring occurs due to the time difference in the shots of different colors.

Conventional technique 3) is equivalent to using two independent sets of recording heads even if the recording heads for the forward path and the backward path are built in the same substrate, and therefore, a color non-uniformity arises due to a large color difference in the form of bands attributable to the difference of the properties of different heads. For example, due to the difference in the data ratio of the forward path data to the backward path data, the temperature of the recording head may be different, and there arises a difference in the ejection amounts between the recording heads, which would result in the color non-uniformity in the form of bands.

Conventional technique 4) provides regularly high frequency color non-uniformity to visually hide the color non-uniformity, but the color difference may be stressed by interference, depending on the print data. For example, when the color difference is produced for each raster line, a large color difference results even if the same color is instructed, when there are a portion where the incidence is high on the even number rasters and a portion where the incidence is high on the odd number rasters in the forward path and the backward path due to a half-tone process such as shading or the like.

In either of method A) or B) for effecting color printing using different droplet sizes, when the recording heads for the respective colors are arranged in the main scan direction, and 1 path bidirectional printing is effected, the non-uniformity due to the bi-directional printing is conspicuous similarly to conventional techniques 3) and 4).

SUMMARY OF THE INVENTION

Accordingly, it is a principal object of the present invention to provide a printing apparatus, a printing method and a print wherein the color non-uniformity attributable to the scanning directions can be reduced even if a bi-directional color print is carried out with different amounts of ink deposited.

It is another object of the present invention to provide a printing apparatus, a printing method and a print wherein the occurrence of the color non-uniformity attributable to the scanning direction is prevented irrespective of the print data with different amounts of ink deposited.

According to an aspect of the present invention, there is provided a printing apparatus for forming a color image by applying different color inks to a printing material while bi-directionally moving the recording head to scan the printing material, said apparatus comprising changing means for changing an order of applications of the inks of different colors to be applied at least at one amount for printing a secondary color to a secondary color pixel area; and forming means for forming the secondary color while making the order of applications of the inks to at least one of a plurality of the secondary color pixel areas arranged along a predetermined direction different from the order of another, by said changing means.

According to another aspect of the present invention, there is provided a printing apparatus for forming a color image by application of different color inks to a printing material while bi-directionally moving the recording head to scan the printing material, said apparatus comprising changing means for changing an order of applications of inks of different colors to be applied at least at one amount to form a process color in a process color pixel area; and forming means for forming the process color by making an order of applications of the inks to at least one of the process color pixel areas arranged in a raster direction different from the order of another, by said changing means.

According to a further aspect of the present invention, there is provided a printing apparatus for forming a color image by effecting scanning bi-directional movement of a recording head having recording elements corresponding to different color inks arranged symmetrically in a scanning direction and applying the color inks at different amounts, said apparatus comprising a plurality of print buffers corresponding to the recording elements arranged symmetrically; and distributing means for distributing print data for a color to be printed to at least one of the print buffers on the basis of an image signal corresponding to the color image.

According to a further aspect of the present invention, there is provided a printing method for forming a color image by application of different color inks onto a printing material at different amounts while bi-directionally moving the recording head to scan the printing material, said method comprising: a first step of application of ink of a certain color ink at least at one amount to form a secondary color to a secondary color pixel area; and a second step of application of different color inks to form the secondary color in the secondary color pixel area in an order of applications which is different from the order in the first step.

According to a further aspect of the present invention, there is provided a print having a color image provided by different color inks, comprising: a printing material; a plurality of secondary color pixel areas arranged in a predetermined direction on the printing material; wherein the plurality of pixel areas are printed by different color inks at least at one amount, and wherein an order of applications of the inks to at least one of the pixel areas is different from the order of another.

With such a structure, the pixel areas of a process color including a secondary color, arranged in a predetermined direction such as the raster scan direction, are dominantly provided by application of the inks in different application orders, and therefore, the orders of applications are substantially the same irrespective of the scanning directions so that generation of the color non-uniformity attributable to the order of applications of the inks can be reduced.

In this specification, the term "printing" or "recording" includes formation, on a recording material, of significant or non-significant information such as an image, a pattern, a character, a figure and the like, and processing of a material on the basis of such information, in a visualized or non-visualized manner.

Here, the "recording or printing material" includes paper used in a normal printer, a textile, plastic resin material, film material, a metal plate and the like which can receive ink.

Here, "ink or liquid" includes liquid usable with the "printing" or "recording" defined above, and liquid usable to form an image, pattern or the like on the printing material or to process the printing material.

The term "pixel area" means a minimum area where a primary color or secondary color is provided by application of one of more inks, and is not limited to a pixel but includes a super pixel or a sub-pixel. The number of scannings to complete the pixel area is not limited to one but may be plural.

The term "process color" includes secondary colors, and means a color provided by mixing three or more colors on the printing material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
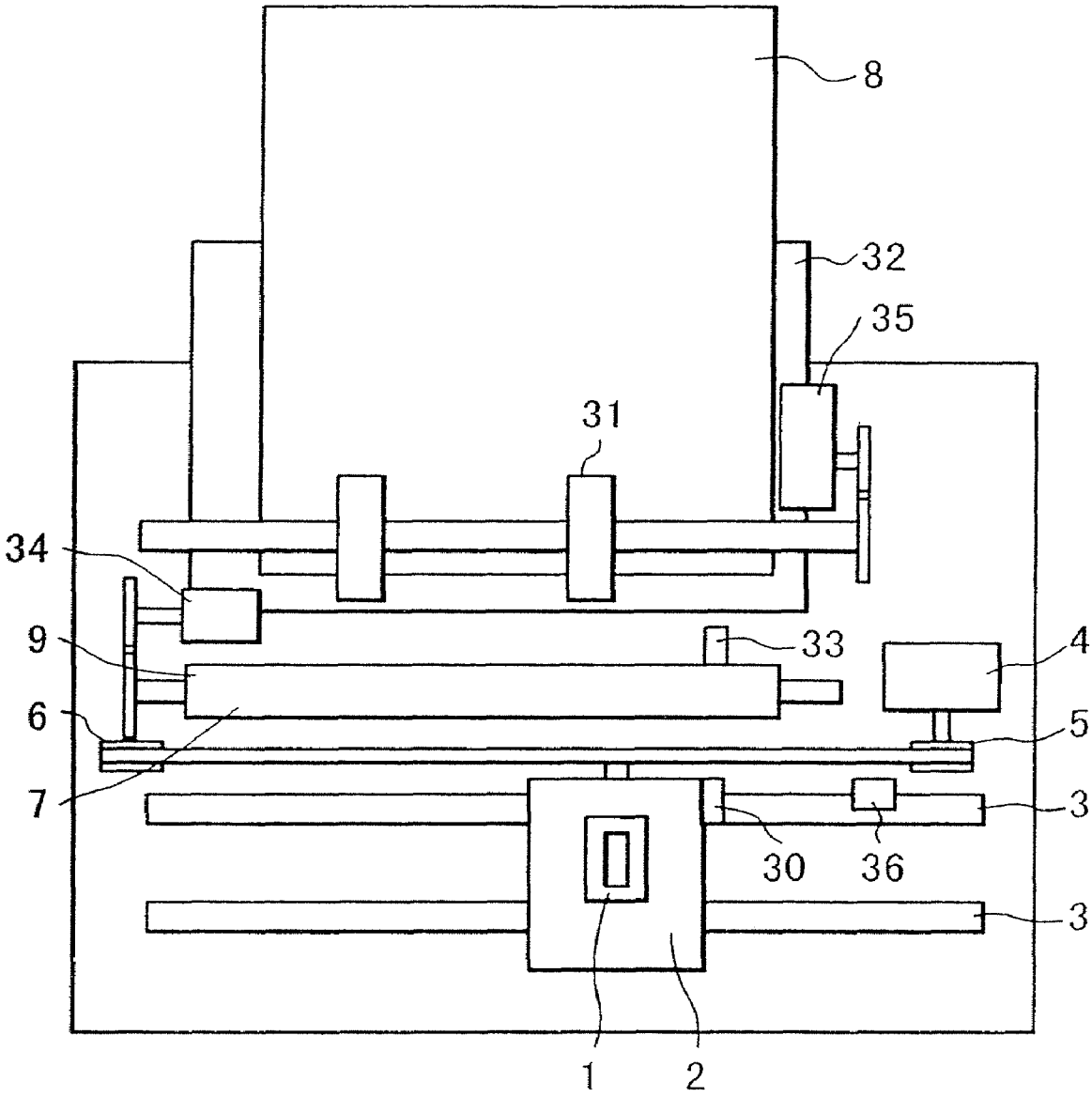
FIG. 1 shows a substantial structure of an ink jet printing apparatus according to an embodiment of the present invention.

In the first embodiment, there is provided control means for effecting control such that when the use is made with a recording head having the recording nozzles for applying respective colors of inks at different amounts which are arranged symmetrically as seen at least in the main scan direction, for pixels which contain at least different color dots to be applied at least at one amount, the occurrence probabilities of different orders of printing of at least the different colors in the forward path print and the backward path print are dominantly equal in effect. In this case, the recording head may have nozzles having a relatively larger ejection amount and nozzles having a relatively smaller ejection amount in combination, or the head may have a variably controllable ejection amount for each nozzle. By doing so, the color non-uniformity attributable to the bi-directional print, which may be caused by synchronism with the configuration data per se of a lateral ruler line or the like or by synchronism with half-toning in the dither or the like, can be prevented.

The above-described structure is effective in a half-tone area, particularly a low density portion of a color image, and for the high density portion, it is effective that for one pixel, a plurality of dots of the same color ink is allotted with respect to at least one color of the used inks and that use is made with means for making it dominant that the order of the shots of the inks constituting the second or higher color for a secondary or higher color is symmetrical.

The description will be made as to the embodiments of the present invention. In the FIGS., the same reference numerals are assigned to elements having corresponding functions.

FIG. 1 shows a structure of a major part of an ink jet printing apparatus according to an embodiment of the present invention.

As shown in FIG. 1, a cartridge 1 is exchangeably mounted on a carriage 2. The head cartridge 1 comprises a print head portion, an ink container portion and a connector portion for receiving and supplying signals for driving the head portion (unshown).

The head cartridge 1 is carried on the carriage 2 at a correct position and is exchangeable, and the carriage 2 is provided with a connector portion and a holder (electrical connecting portion) for transmission of the driving signals or the like to the head cartridge 1 through the connector.

The carriage 2 is reciprocably supported and guided by a shaft 3 and a guide of the main assembly of the apparatus, which is extended in a main scan direction. The carriage 2 is driven through a driving mechanism such as a motor, a pulley 5, a driven pulley 6, a timing belt 7 or the like by a main-scanning motor 4, and the position and the movement are controlled. A home position sensor 30 is carried on the carriage. By this, the position of the carriage 2 can be detected when the home position sensor 30 of the carriage 2 passes by the shielding plate 36.

The print mediums 8 in the form of print sheets, thin plastic resin sheets or the like are fed out one by one from the automatic sheet feeder ("ASF") by rotating the pick-up roller 31 through a gear by a sheet feeding motor 35. By rotation of the feeding roller 9, the sheet is fed through (scanned by) a position (print portion) where the sheet is opposed to the ejection outlets of the head cartridge 1. The feeding roller 9 is rotated through the gear by rotation of the LF motor 34. At this time, the discrimination of the sheet feeding and the determination of the leading edge of the sheet is effected by the timing at which the print medium 8 passes by the paper end sensor 33. The paper end sensor 33 is also effective to detect the actual position of the trailing edge of the print medium 8 and to make the final determination of the current recording position.

The print medium 8 is supported by a platen (unshown) at its back side so as to provide a flat print surface at the print portion. The heads and cartridges 1 on the carriage 2 are supported such that ejection side surfaces thereof are faced downward in parallelism with the print medium 8 between the feeding rollers constituting a pair.

The head cartridge 1 is an ink jet head cartridge which ejects the ink using thermal energy, and is provided with electrothermal transducers for generating the thermal energy. In this example, the print head of the head cartridge 1 ejects the ink through the ejection outlet using the pressure of the bubble generated by film boiling caused by the thermal energy applied by the electrothermal transducer. Another type using a piezoelectric element to eject the ink, or the like is usable.

Figure 2:
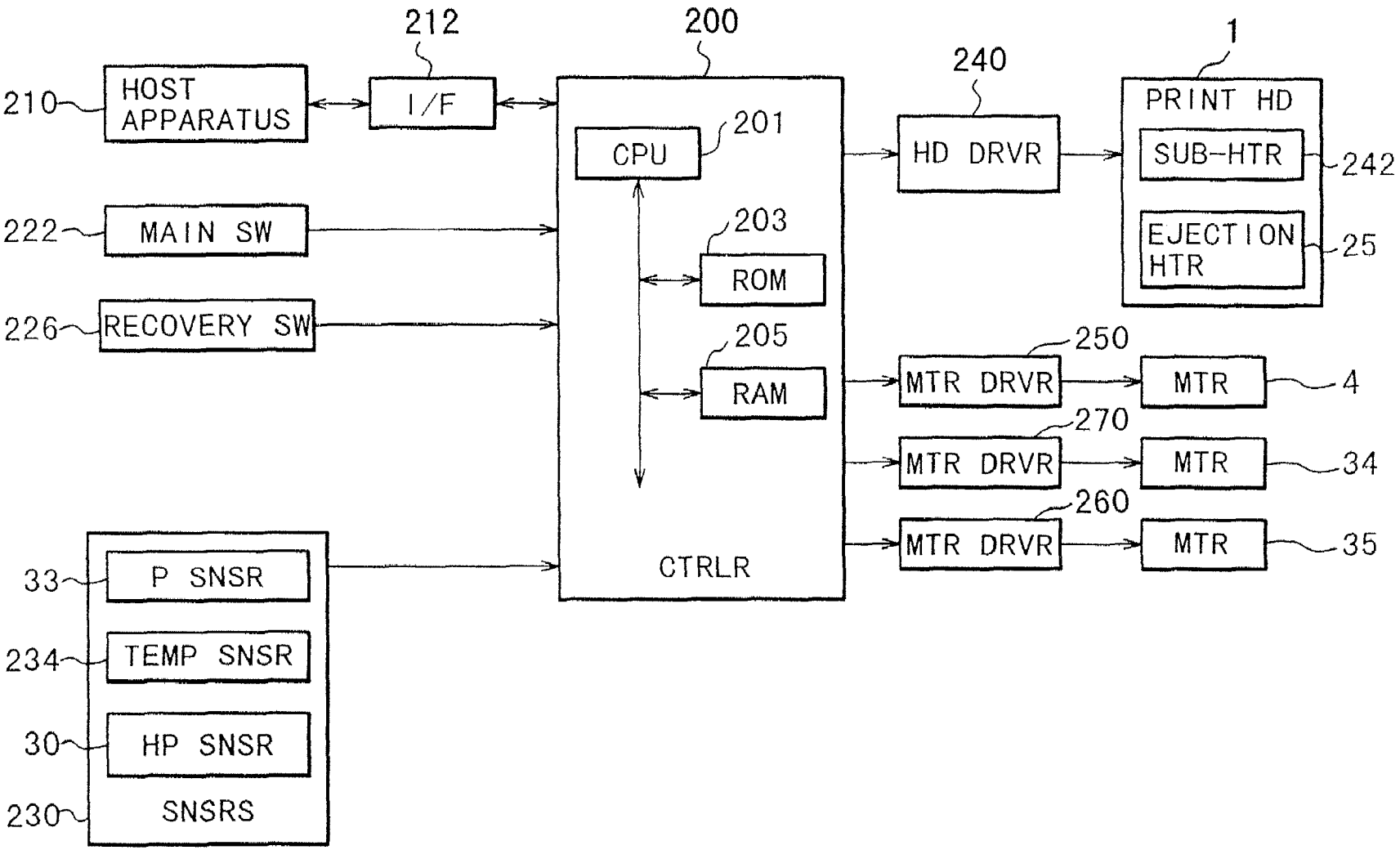
FIG. 2 is a block diagram of a control circuit for a printing apparatus.

FIG. 2 is a block diagram of a control circuit in the ink jet printing apparatus.

In FIG. 2, a controller 200 is a main controller, and comprises a CPU 201 (a micro computer or the like), ROM 203 storing a program, a table, fixed data or the like, and RAM 205 having an area for conversion of image data and a working area. The host apparatus 210 may be a supply source of image data (a computer for carrying out production and processing of data such as an image to be printed, or a reader portion for reading the image to be printed, or the like). The image data, command, a status signal or the like are transmitted to and from the controller 200 through the interface (I/F) 212.

The operating portion 120 includes a group of switches for actuation by the operator, and includes a main switch 222, and a recovery switch 226 for instructing the start of a suction refreshing operation.

A group of sensors includes sensors for detecting states of the apparatus, more particularly, the above-described home position sensor 30, a paper end sensor 33 for detecting presence or absence of the print medium and temperature sensors 234 or the like disposed at proper positions for detecting the ambient temperature.

The head driver 240 is a driver for actuating the ejection heater 25 of the head cartridge 1 in accordance with the print data. The head driver 240 includes a shift register for aligning the print data corresponding to the positions of the ejection heater 25, a latching circuit for effecting latching at proper timing, a logic circuit element for actuating the ejection heaters in synchronism with the drive timing signal, and a timing setting portion for appropriately setting the drive timing (ejection timing) for dot formation and position alignment, or the like.

The heat cartridge 1 is provided with a sub-heater 242. The sub-heater 242 functions for temperature adjustment for stabilizing the ink ejection property, and may be formed on the print head substrate simultaneously with the formation of the ejection heater 25 or may be mounted on the head cartridge or on the main body of the print head.

The motor driver 250 functions to actuate the main-scanning motor 4, and the sub-scan or LF motor 34 functions to feed the print medium 8 (sub-scan), and the motor driver 270 is a driver therefor.

The sheet feeding motor 35 is a motor for separating and feeding the print medium 8 from the ASF, and the motor driver 260 is a driver therefore.

Embodiment 1

Figure 3:
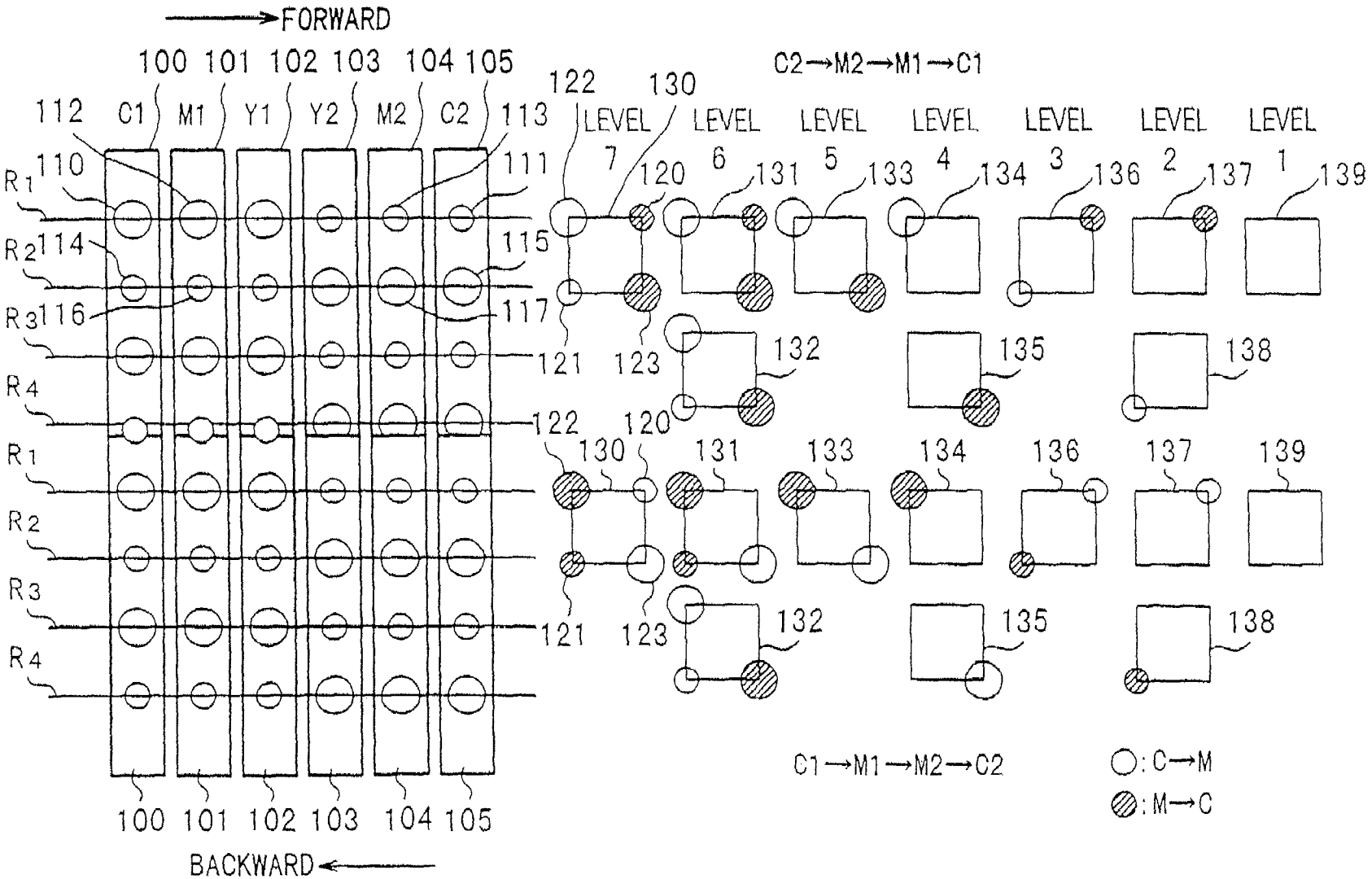
FIG. 3 shows an example of a recording head, an allotment of ejection nozzles and pixels according to an embodiment of the present invention.

FIG. 3 is a partial schematic view of a major part of a recording head portion of a head cartridge 1. In this Figure, designated by 100 is a first recording head for ejecting cyan ink (C1). Designated by 101 is a first recording head for ejecting magenta ink (M1). Designated by 102 is a first recording head for ejecting yellow ink (Y1). Designated by 103 is a second recording head for ejecting yellow ink (Y2). Designated by 104 is a second recording head for ejecting magenta ink (M2). Designated by 105 is a second recording head for ejecting cyan ink (C2). Additionally, a recording head for ejecting Bk ink may be used.

The head cartridge 1 is constituted by such recording heads.

In head cartridge 1, each of the recording heads includes a plurality of ejection nozzles. For example, the recording head 100C1 includes cyan ejection nozzles 110 for ejecting a relatively larger size of droplet of cyan ink. The recording head 101M1 includes magenta ejection nozzles 112 for ejecting a relatively larger size of magenta droplet. The recording head 104M2 includes magenta ejection nozzles 113 for ejecting a relatively smaller size of magenta droplet. The recording head 105C2 includes cyan ejection nozzles 111 for ejecting a relatively smaller size of cyan droplet.

The nozzles of each of the recording heads are arranged in a direction perpendicular to the main scan direction. Strictly, they may be slightly inclined relative to the main scan direction in consideration of the ejection timing. The recording heads are arranged in the same direction as the main scan direction. More particularly, in the example of FIG. 3, each of the recording heads 100C1, 101M1, 102Y1, 103Y2, 104M2 and 105C2 is arranged in the same direction as the main scan direction.

The two recording heads for the respective colors are disposed such that nozzles for ejecting relatively larger droplets and the nozzles for ejecting relatively smaller droplets alternate in the opposite directions; that is, the nozzles for ejecting the same amount of inks are staggered.

Here, the intervals of the nozzles are arranged at the density of 720 dpi, and therefore, the nozzles for ejecting the relatively larger droplets are disposed at the density of 360 dpi, and the relatively smaller droplet ejecting nozzles are disposed at the density of 360 dpi.

In FIG. 3, the dot positions 122, 123 of the pixel 130 are allotted with dots provided by relatively larger cyan and magenta droplets, and the positions 120, 121 are allotted with dots provided by relatively smaller droplets. The dot position 122 is the position to which the dot ejected through the ejection nozzle 110 of the recording head 100C1 and the dot ejected through the ejection nozzle 112 of the recording head 101M1 are allotted, for the area of the pixel 130.

The dot positions 122 in this Figure are the positions allotted for the dot provided by the ejection nozzle 117 of the recording head 104M2 and the dot provided by the ejection nozzle 115 of the recording head 105C2, both for the area of the pixel (picture element) 130. In this example the dot position 122 is located on the upper right position of the diagonal line, and the dot position 123 is located on the upper left position.

The dot position respective in the same Figure is the position to which the dot ejected through the ejection nozzle 113 of the recording head 104M2 and the dot ejected through the ejection nozzle 111 of the recording head 105C2 are allotted for the region of the pixel 130. The dot position 121 in the same Figure indicates the position to which the dot ejected through the ejection nozzle 114 of the recording head 100C1 and the dot ejected through the ejection nozzle 116 of the recording head 101M1 are allotted for the region of the pixel 130. Here, dot position 120 is the upper right diagonal position, and the dot position 121 is the lower left diagonal position. Designated by R1-R4 are main-scanning lines for the pixels, namely, raster lines. Here, 1 pixel is provided by 2 raster scans.

Therefore, the pixels are arranged at the resolution of 360 dpi×360 dpi. In the same Figure, the inks of the different colors are printed dot-on-dot in each pixel. The blue color (secondary color) is provided by cyan and magenta. The dot position 122 receives the ink from the magenta ejection nozzle 112 of the recording head 101M1 in the forward path, and then receives the ink from the cyan ejection nozzle 110 of the recording head 100C1. From the above-described principle, the color of the first ink (magenta in this case) normally tends to be dominant, that is, the color is relatively closer to the burgundy color, at the dot position 121.

The same relation applies to portions 120, 121 to which the relatively smaller dots are allotted.

The print in the backward path will be considered. The ink from the cyan ejection nozzle 110 of the recording head 100C1 and the ink from the magenta ejection nozzle 112 of the recording head 101M1 are printed in this order. The color of the first ink (magenta in this case) normally tends to be dominant, that is, the color is relatively closer to the violaceous color, at the dot position 123. Similarly, in the backward path, the dot position 120 receives the ink from the magenta ejection nozzle 113 of the recording head 104M2, and then receives the ink from the cyan ejection nozzle 111 of the cyan of the recording head 105C2. The color of the first ink (magenta in this case) normally tends to be dominant, that is, the color is relatively closer to the burgundy color, at the dot position 123.

The same relation applies to portions 120, 121 to which the relatively smaller dots are allotted.

In FIG. 3, white circles indicate dots where the magenta ink is printed and then the cyan is printed thereafter, and hatched circles indicate dots where the inks are deposited in the opposite order. The dots are disposed at four corners, but this is not limiting, and the dots may be disposed at any position if they are in the pixel area. Further alternatively, all of the dots may be printed dot-on-dot. Even in the deviated arrangement, the dots in the pixel area are generally overlapped partly with each other.

In this manner, the blue relatively closer to burgundy (burgundy blue) and the blue relatively closer to violaceous (violaceous blue) always appear as a pair. Microscopically, the differently colored dots appear diagonally. When this is seen on the pixel 130 macroscopically, the orders of shots (applications) of the ink are such that the larger size dots and relatively smaller size dots are symmetrical in the pixel structures. Therefore, in the single pixel, the intermediary blue color can be uniformly provided.

In this invention, it is dominant that colors constituting a secondary color for a pixel are symmetrically printed for the pixel. In this example, the blue color (cyan and magenta) is taken as the secondary color, but it will be readily understood that the present invention is applicable to the red color (magenta and yellow) and to the green color (cyan and yellow).

In this embodiment, 7-level data (3 bits) (level 1 means minimum density (non-ejection); and level 7 means the maximum) for each one component color corresponding to each color are normally used. The number of bits is not limited to 3 bit, but may be 4 bit or the like. Furthermore, even when the 3 bit data are used, only predetermined levels may be used. Particularly, the bit number is determined in view of the relation between the recording resolution and the dot diameter from the standpoint of the design philosophy of the degrees of the tone gradation for each pixel and the maximum density, and the present invention is usable with any of them.

The pixels indicated by reference numerals 130-139 in FIG. 3 show states of dots allotted in accordance with tone gradation data ranging between level 1 to level 7.

The pixels 133 in FIG. 3 correspond to a datum of level 5, and are printed by only relatively larger dots of the same head structure. The pixels 136 in FIG. 3 correspond to a datum of level 3, and are printed by only relatively smaller dots from the same head structure. Each of these pixels constitutes a 2 dot pair for each size, and therefore, the result is that pixel structure is such that the relatively larger dots and the relatively smaller dots are disposed symmetrically irrespective of whether they are printed in the forward path or in the backward path. Therefore, looking at each pixel, the blue coloring is uniform.

The pixel 139 corresponds to level 1 data, that is, no print. In this case, no ink is applied, so that there is no need of considering difference in the coloring attributable to the difference in the scanning moving direction.

Regarding a half-tone image other than those described above within the pixel, the 2 dot pair results in the maximum density in the same size, and therefore, the dots are unable to be allotted in the 2 dot pair type. Namely, any pairing of dots with symmetrical shooting order cannot be used.

In this embodiment, for such dots of each pixel, the control is effected such that occurrence probabilities, in the forward path and the backward path, of at least the pixels in which the order of prints for each color are different, are substantially the same, by which the coloring provided by the forward path printing and the coloring provided by the backward path printing are macroscopically the same.

Pixels 131 and pixels 132 show the dot arrangement corresponding to level 6 data. In pixels 131 and pixels 132, the relatively larger dots are symmetrical in the printing order in the forward path and in the backward path, but at positions 120, 121, the dot disposition is such that relatively smaller dots where the order of printing is opposite are only at one side. In the pixels 131, there are more blue dots which are relatively closer to the violaceous color (the coloring of cyan which has been shot first is dominant). Since the additional dots are relatively smaller dots, their influence is less significant than the relatively larger dots, but the hue is a little different. In the pixels 132, there are more blue dots which are relatively closer to the burgundy color (the coloring of magenta is dominant). Since the dots are relatively smaller dots, the influence is less significant than the relatively larger dots, but the hue is a little different.

Pixels 137 and pixels 138 show the dot arrangement corresponding to level 2 data. At the pixels 137, 138, use is made only of relatively small dots which are shot in opposite order only at one side. Therefore, the pixel 137 is blue which is relatively closer to violaceous color (closer to cyan which has been shot first).

The pixel 138 is, on the contrary, blue which is relatively closer to burgundy color (closer to cyan which has been shot first). The same applies to the pixels 134, 135 which correspond to the data of level 4.

In this embodiment, a plurality of dot arrangements corresponding to the same level data (pixels 131 and 132 for the data of level 6, for example) are switched over both in the forward path and backward path of the print scanning, that is, the asymmetrical shooting order is switched in the recording scan. For the switching, use is made of a recording head in which the shooting orders of the nozzles for each color are symmetrical with respect to the main scan direction, which is one of the features of this embodiment. In other words, the order of shooting can be changed in the one main recording scan by selecting which recording nozzle of the two same color symmetrical nozzles, which are arranged in the main scan direction, is allotted to the dot.

In this embodiment, when the dots are assigned for the data of each color, the dot-on-dot structure is provided, as shown in FIG. 3. However, even if the dot is allotted to the position deviated in the main scan direction, another deviated position is satisfactory if it is within the pixel area.

Figure 4:
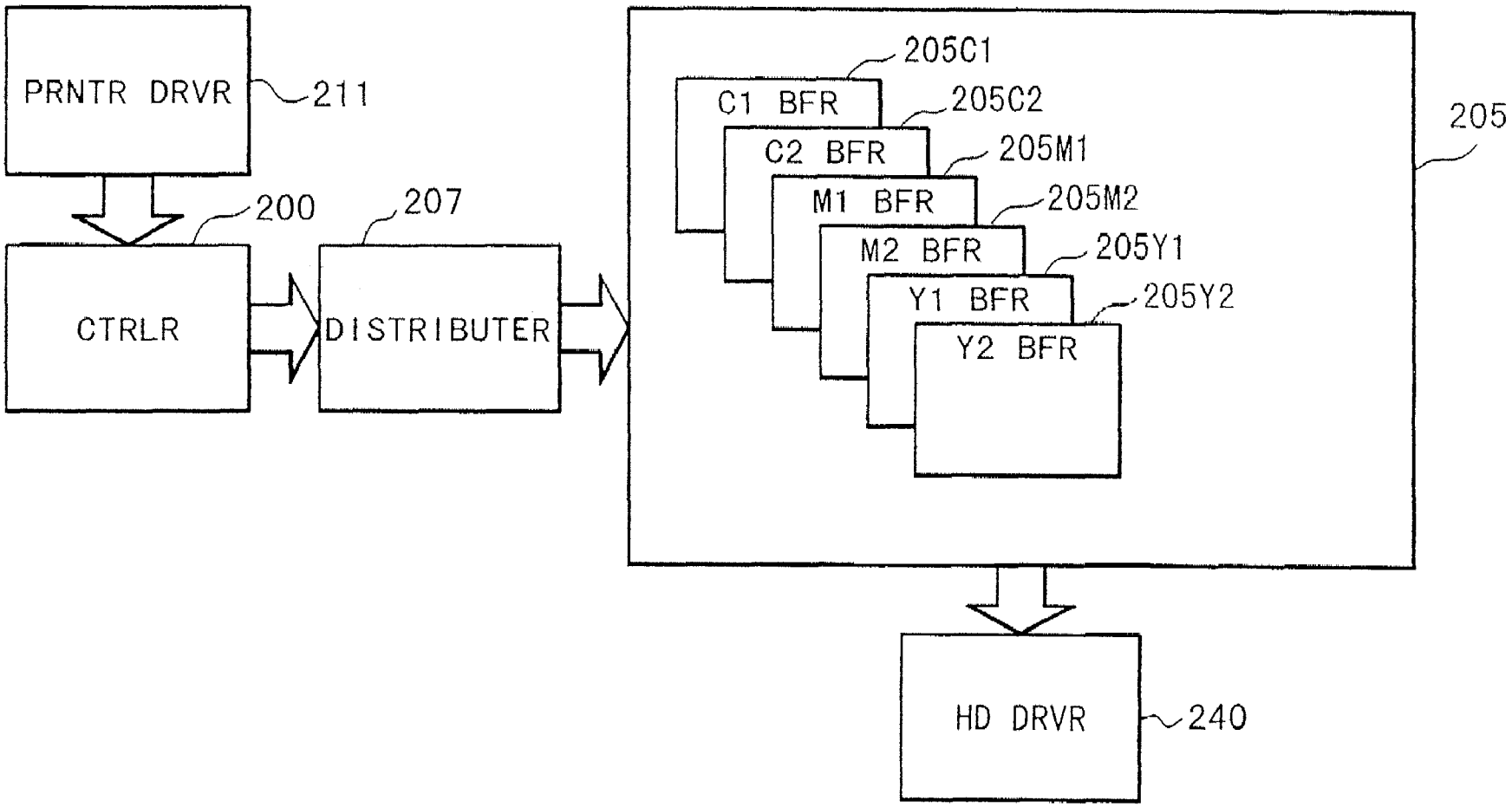
FIG. 4 is a block diagram illustrating a buffer structure for the print data according to the present invention.

FIG. 4 shows a data buffer structure of the printing apparatus according to this embodiment.

In this figure, a printer driver 211 is actuated by a program for generating image data in a host apparatus 210 and for supplying the generated data to the printing apparatus. The controller 200 converts the image data supplied from the printer driver 211 if necessary and distributes them as 4 bit data for each color (CMY) per pixel. The distribution circuit 207 writes the data for each of CMY colors in the print buffer 205 such that the dots are allotted to meet the dot allotments and levels shown in FIG. 3.

For example, 3 bit data at 360 dpi are written for the cyan color (levels 1-7 in FIG. 3). In this type of the embodiment, 2 bit data is written in the buffers 205C1, 205C2 for the recording heads 100C1 and 105C2, respectively (4 bits in total). When the recording heads reach the predetermined positions for the recording for the pixels, the data in the buffer are read in the registers in the recording heads to effect the printing operations. By such data and the buffer structure, the printing can be effected on the sub-pixels from the different recording heads, for the 2 dot pairs. Here, the case of CMY is discussed, but the same applies to the case of CMYK, to the case of light and dark inks or other colors.

At this time, several combinations of dots are possible depending on the way of writing the respective data. When all of the sizes of dots are used as with the pixel 130 shown in FIG. 3, that is, when the level is at 7, "11" is written in the Cl buffer 205C1 shown in FIG. 4. The value "11" is indicative of ejecting the ink from both of the nozzle 110 for ejecting relatively larger ink droplets and the nozzle 114 for ejecting relatively smaller ink droplets. Similarly, "11" is written in the buffers 205M1, 205M2 and 205C2.

When the use is made of two dots having the relatively larger size and one dot having the relatively smaller size as with the pixel 131 in FIG. 3, that is, when the level is at 6, "10" is written in the C1 buffer 205C1 shown in FIG. 4. The value "10" is indicative of ejecting the ink only from the nozzle 110 for ejecting relatively larger ink droplets. On the other hand, "11" is written in the C2 buffer 205C2. Similarly, the same is written in the buffers 205M1, 205M2.

In the case of level 6, as described hereinbefore, the distribution circuit 207 controls the writing into the buffer such that incidence probability of the pixel 131 and the incidence probability of the pixel 132 are substantially equal. When the pixel 132 is used, "11" is written in the C1 buffer 205C1 of FIG. 4. On the other hand, "01" is written in the C2 buffer 205C2. The value "01" is indicative of ejecting the ink only from the nozzle 115 for ejecting relatively larger ink droplets. Similarly, the same is written in the buffers 205M1, 205M2.

In such a manner, the data is written in the buffers by the distributing circuit 207 such that the incidence probabilities of the data "10" and "11" and the data "11" and "01" are substantially equal.

For the other levels 4, 2, the processing is the same as with level 6.

The print buffers 205C1, C2, M1, M2, Y1, Y2 are provided in the RAM 205.

In such a case, the distribution may be alternating (sequential) distribution of the data to the plurality of (two, here) the buffers or may be random distribution. What is desired is that orders of ink applications are not one-sided. More desirably, the incidences are fifty-fifty for the above-described reasons.

It is not necessary to use all of the tone gradation levels shown in FIG. 3. For example, in the high density portion, the density change saturates with respect to the number of dots allotted, and therefore, a binarization process may be carried out so that data containing only level 6 is used.

When it is desired that spatial frequency be raised by reducing the intervals between the dots in an image so as to reduce the roughness of the image, that complete overlap of the dots be avoided or that non-uniformity in the form of stripes be avoided, the distribution circuit 207 may effect the distribution on the basis of checking of the appearances of CMY so as to avoid the overlapping of the dots.

Although with respect to FIG. 3, the description has been made with respect to the dot allotment for the cyan and magenta colors and the blue color, which is a secondary color provided by them, the same applies to the yellow and the other secondary colors (green and red).

In the foregoing Embodiments, the description has been made with the examples in which each pixel is printed with a combination of at least the relatively larger dot and the relatively smaller dot. However, the present invention is not limited to these examples.

More particularly, with a printer capable of expressing tone gradation by different sizes of dots, the image can be formed only by relatively larger dots or only by relatively smaller dots, depending on the resolution with which the printing is to be effected. The present invention is applicable to such a printer.

The symmetrical shape recording head usable with the present invention is not limited to the structure shown in FIG. 3. For example, the recording heads shown in FIGS. 5 to 9 are considered as usable examples, but any other structure is also usable if the advantageous effects of the present invention are provided.

Figure 5:
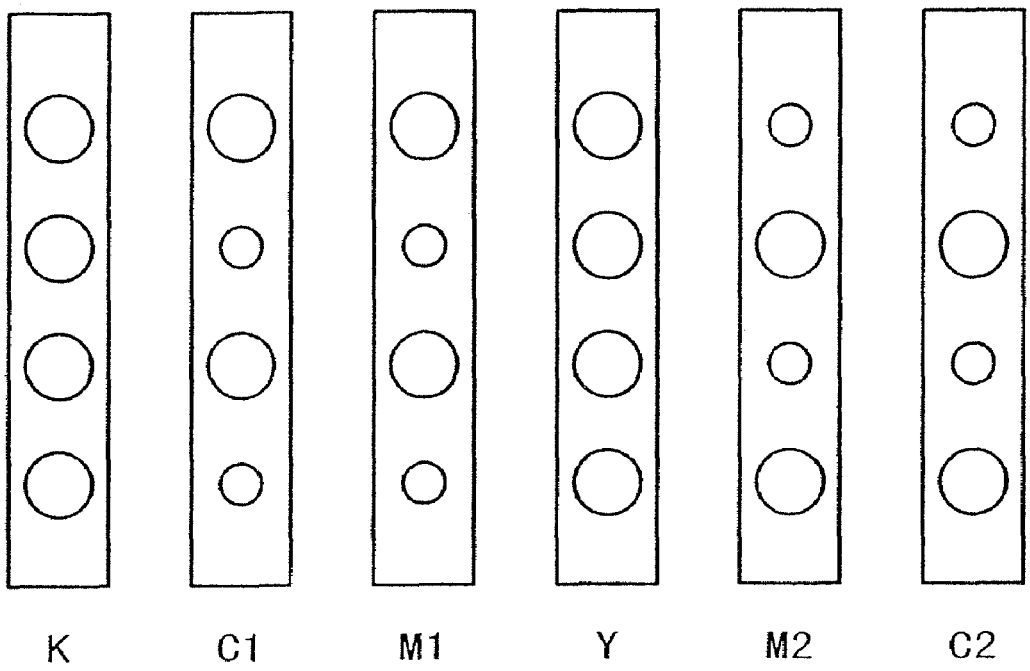
FIG. 5 illustrates another example of the structure of the recording head and the ejection nozzles.

FIG. 5 shows an example which is similar to the example of FIG. 3, but a black recording head for ejecting black (K) ink is added to the left-hand end, and only one yellow (Y) head is located at the center of symmetry, by which the structure is simplified. The recording head at the center of the symmetry prints later irrespective of the scanning direction. In this example, the yellow recording head is located at the center of the symmetry, but this is not limiting.

For the black recording head and the yellow recording head, only the nozzles for ejecting relatively larger droplets are provided. The former is in order to provide high density for the black, and the latter is because that yellow color is less conspicuous.

Figure 6:
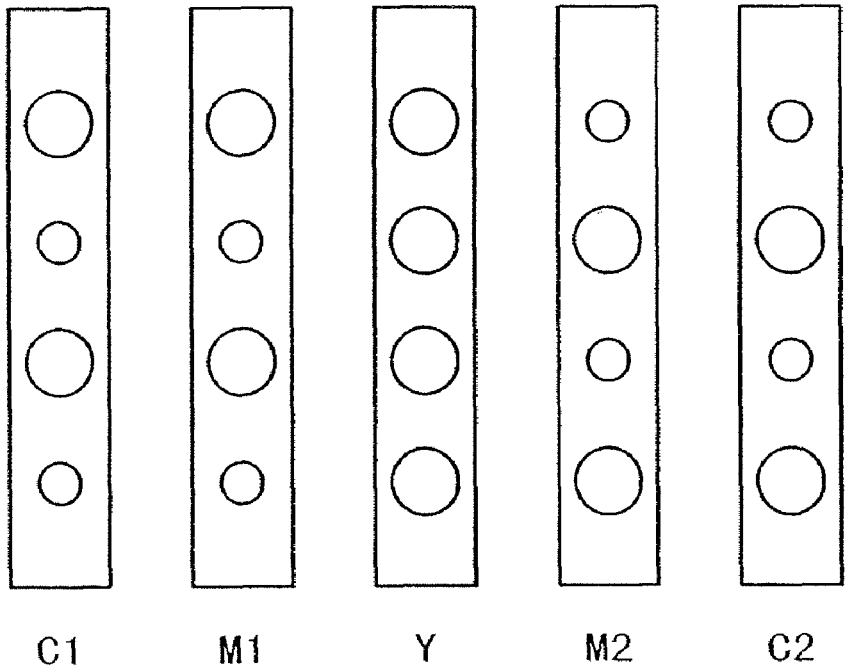
FIG. 6 illustrates another example of the structure of the recording head and the ejection nozzles.

FIG. 6 shows an example which is similar to the FIG. 5 example, but the black recording head for ejecting the black ink is omitted.

Figure 7:
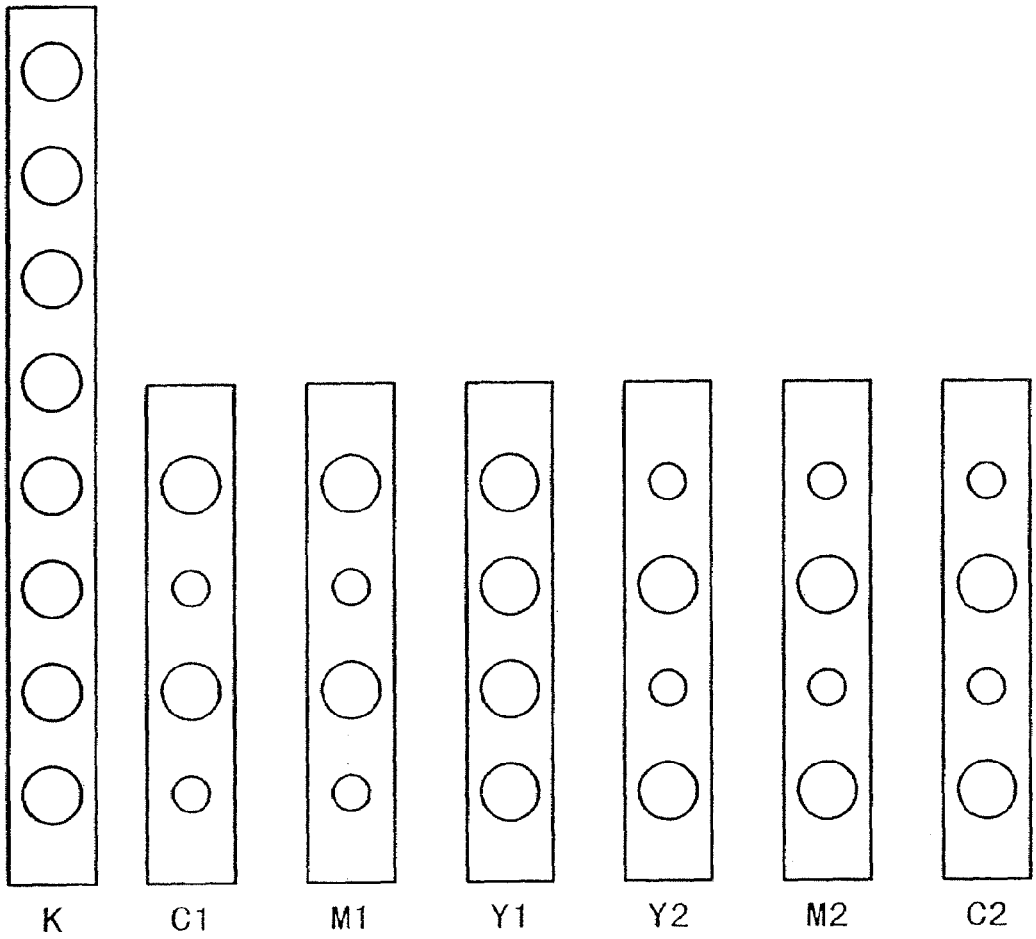
FIG. 7 illustrates another example of the structure of the recording head and the ejection nozzles.

FIG. 7 shows an example having a recording head for the black color in addition to the structure shown in FIG. 3. The black ink is generally not used for printing the secondary color, and therefore, there is no need for a symmetrical arrangement. In order to permit a higher speed printing operation in a monochromatic recording mode, the number of the nozzles for the black color is larger than that of the other chromatic heads.

Figure 8:
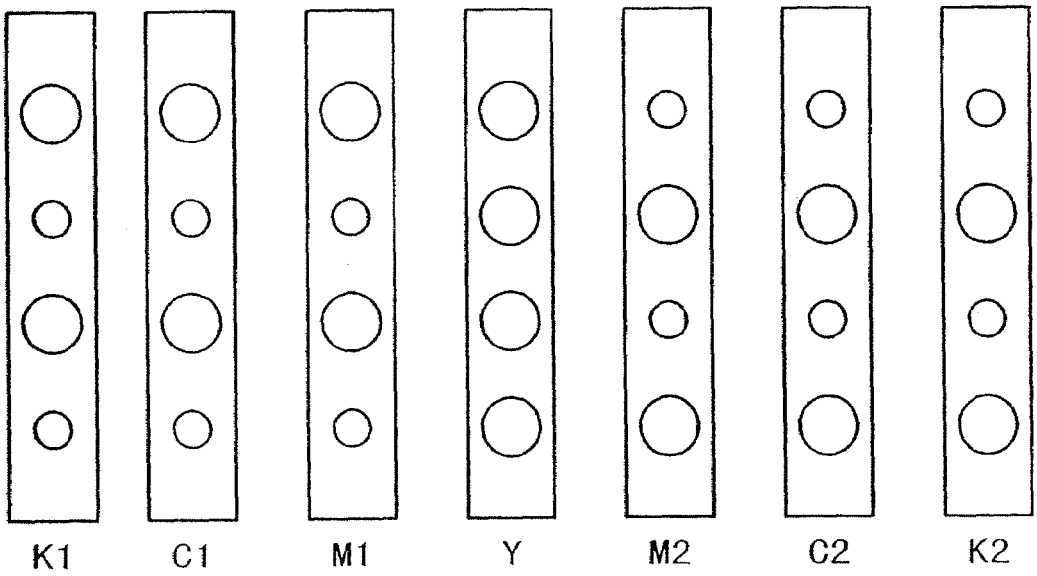
FIG. 8 illustrates another example of the structure of the recording head and the ejection nozzles.

FIG. 8 shows an example which is similar to FIG. 6, but black (K) recording heads are added at symmetrical end positions.

Figure 9:
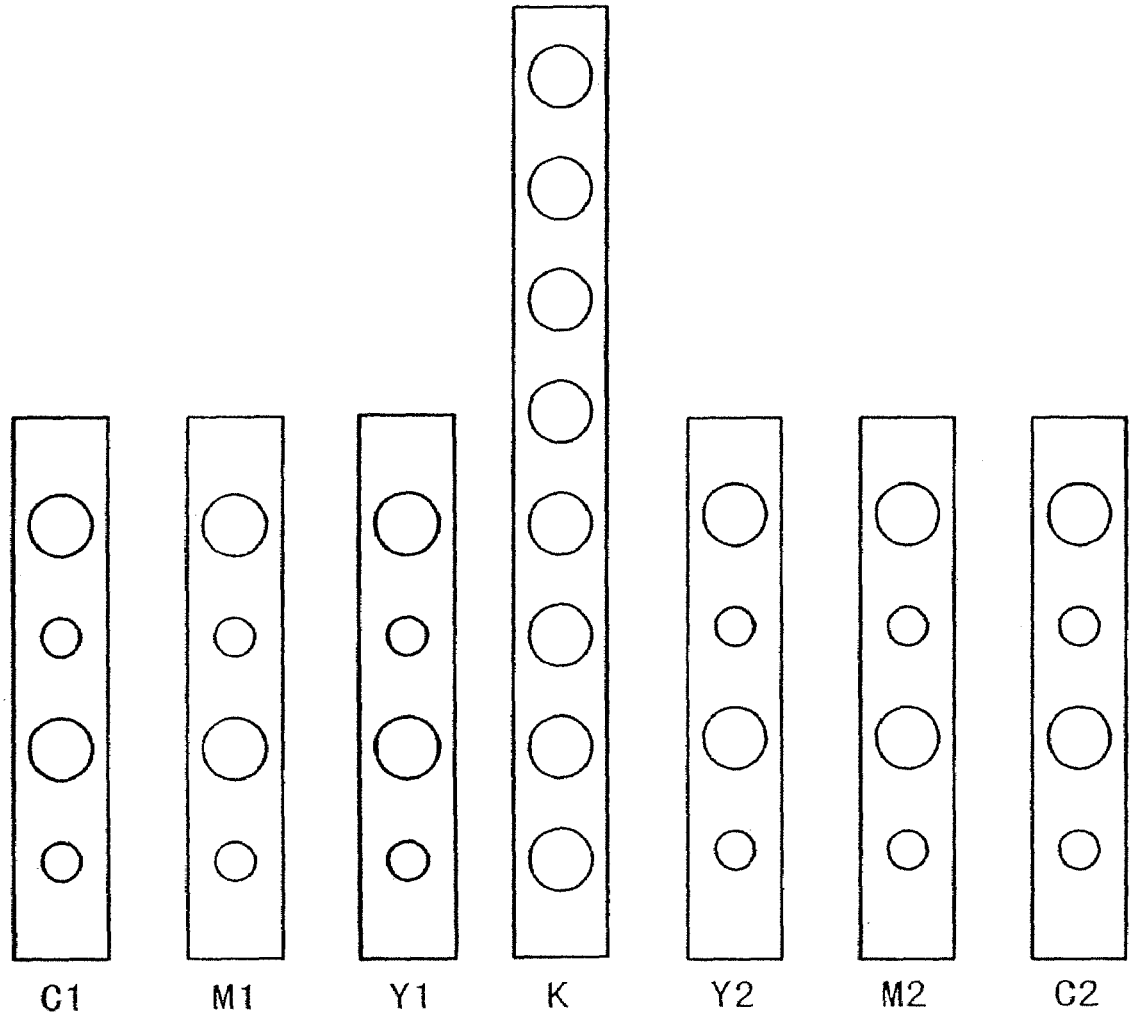
FIG. 9 illustrates another example of the structure of the recording head and the ejection nozzles.

FIG. 9 shows an example which is similar to the FIG. 7 example, but a black recording head is located at the center of symmetry.

Embodiment 2

The combinations of dots are not limited to those described in the foregoing, but various combinations are usable. In FIG. 3, when the secondary color is to be printed, the dot-on-dot structure necessarily results, but this is not limiting, and the dot arrangement with which the dots do not tend to overlap with each other when the binarization process is effected is possible.

Figure 10:
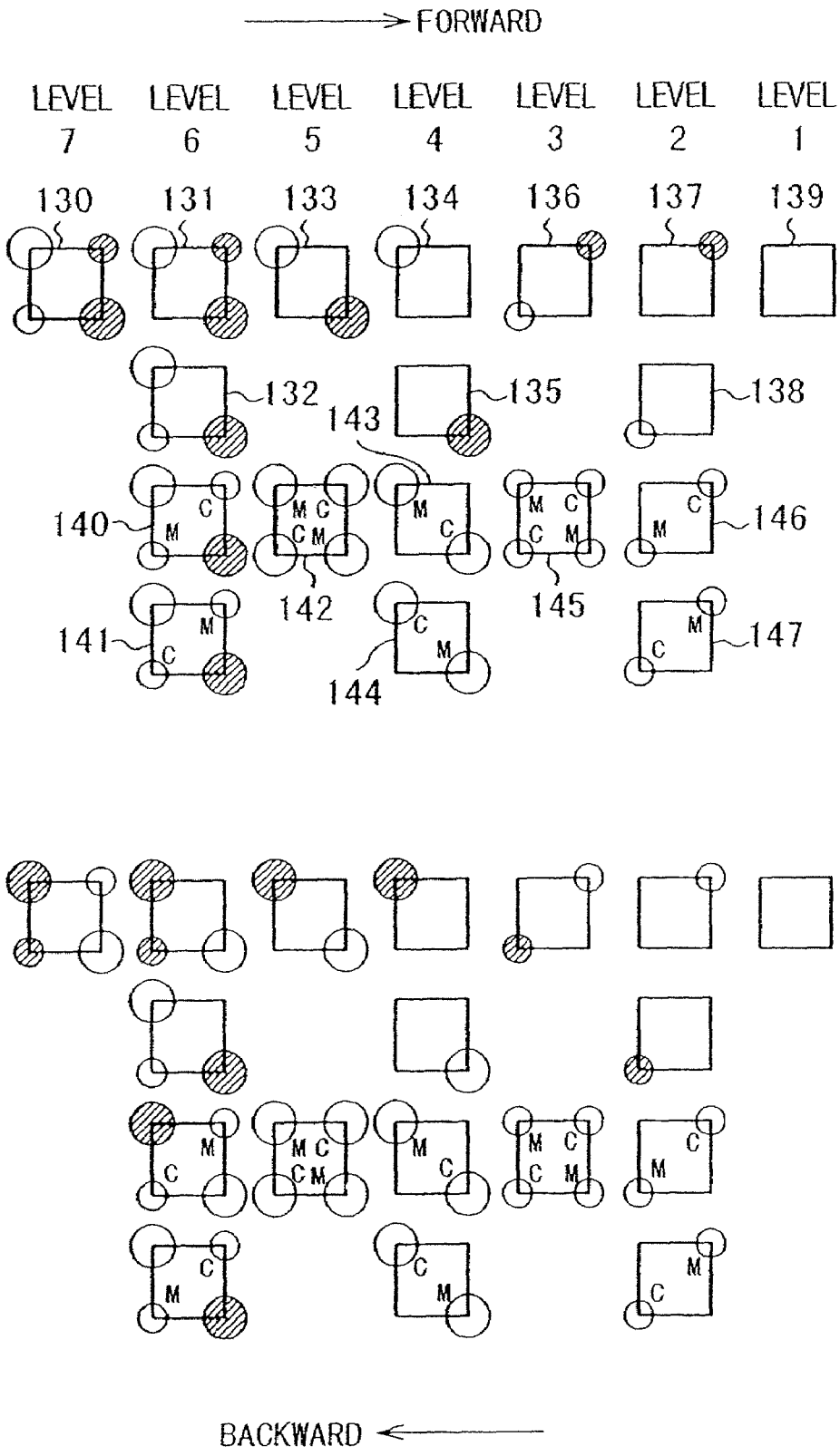
FIG. 10 illustrates a structure of a pixel according to a second embodiment of the present invention.

FIG. 10 shows an embodiment in which the dots are allotted in such a manner. The dot arrangement of FIG. 10 is similar to that of FIG. 3, but an arrangement in which the dots are separated or deviated (pixels 140-147) is added to the previous dot arrangement (pixels 130-139).

For example, at level 6, pixels 140, 141 at which the relatively smaller dots are split (not dot-on-dot) are added. By the distribution circuit, the data are stored in the buffer such that incidence probabilities of the pixels 131, 132, 140, 141, at which the level is at 6, are substantially equal along the raster scan direction.

At level 5, a pixel 142, at which relatively large dots are split (not dot-on-dot), is added. In Embodiment 1, only one type of pixel structure for expressing level 5 was provided. In this embodiment, however, there are provided two kinds of pixel structures (pixels 133 and 142). The distribution circuit causes the buffer to store the data such that incidence probabilities of such pixels are substantially equal.

In this embodiment, the two dots are located diagonally in each of the pixel areas, that is, they are arranged separately. In FIG. 10, however, the relatively larger dots are partly overlapped with each other, not completely overlapped though. But, the relatively smaller dot hardly contact each other.

Figure 11:
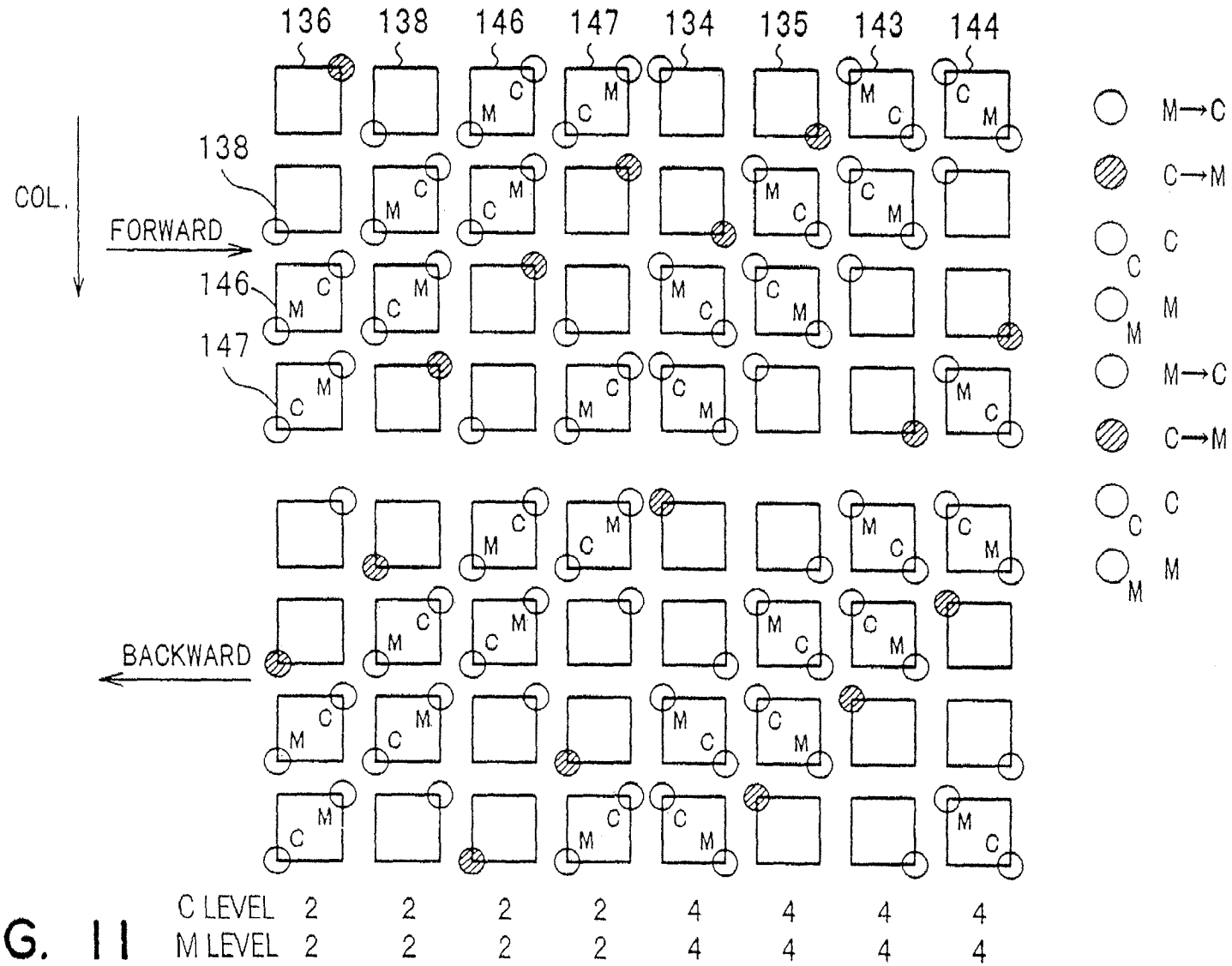
FIG. 11 shows an example of image formation according to the second embodiment of the present invention.

FIG. 11 shows a specific example of a dot arrangement for the data of blue at level 2 and cyan at level 4, that is, cyan and magenta are at level 2 and at level 4, among the combination shown in FIG. 10.

In this figure, the distribution circuit distributes the data such that incidence probabilities of the same level pixels are substantially equal in the raster scan direction and in the column direction (the direction in which the nozzles are arranged) as well. For example, the pixels of level 2 at the top in the Figure are arranged in the order of pixels 136, 138, 146, 147, in the direction of the raster scan, and the pixels of level 4 are arranged in the order of pixels 134, 135, 143, 144. On the other hand, the pixels of level 2 at the leftmost column are arranged in the order of pixels 137, 138, 146, 147 in the column direction. The same as with the case of the forward path applies to the backward path.

As described in the foregoing, the control is effected such that occurrence probabilities of the pixels, in which the order of prints for each color are different, are substantially equal in the forward and backward raster scan directions and in the column direction, by which the coloring is substantially uniform macroscopically in the forward and backward directions and the column direction.

In the pixels 142-147 added as the dot arrangement responding to levels 5-2, the dots are separated, namely, the dot-on-dot does not exist, the spatial frequency is high so that densities of the dots are not high even when the macroscopic densities are the same, and therefore, the granularity of the image can be reduced. The effects are remarkable when the percentage of the added separation type pixels is increased by the distribution.

Moreover, the control may be effected such that data for the level (tone gradation) 2 and/or 4 do not result in dot-on-dot arrangement.

It is desirable that at least for the large dots with which the degree of overlapping between different colors is large, the incidence probabilities of the orders of shots (first and second) are substantially equal.

In this embodiment, when the relatively smaller dots are disposed diagonally in the pixel area, the dots do not contact each other, and therefore, the coloring is hardly influenced by the order of shots. Therefore, the pixels 146 and 147 having the added arrangement is fixed to one of them, so that coloring is substantially uniform without the distribution. On the contrary, when the 2 dot pair of the relatively larger dots such as the dots at level 6 is added with a relatively smaller dot, the influence of the 2 dot pair in which the order of shots is symmetrical is dominant, and therefore, the shots may be fixed in one of the pixels 131, 132, 140, 141 without the distribution, by which the coloring is substantially uniform.

Embodiment 3

In Embodiment 1 described hereinbefore, one pixel is constituted by a pair of two dots of the same size, and the order of shots of a pair of different size dots of the same color ink is symmetrical, at least for one color. In such examples, one pixel is constituted by a pair of two dots, and therefore, the examples are preferable when the maximum density of print is desirable such as when the images are formed on an OHP sheet. When the maximum density is not required, the maximum density may be provided by the relatively larger dot.

In Embodiment 2, for high density portions, the order of shots of the same coloring is symmetrical at least for one color as in the foregoing Embodiments, and in the half-tone portions, use is made of a symmetrical recording head for bidirectional printing, and the combinations of the used recording heads are switched between when the recording heads scan in the forward direction and when they scan in the backward direction. By doing so, the half-tone can be expressed in addition to the high density portion, in the bi-directional print.

It is known that when a so-called lateral recording head unit, in which the recording heads for the respective colors are arranged in the main scan direction, is used for the bi-directional printing, the order of printing shots is different between when the recording heads scan in the forward direction and when they scan in the backward direction, and therefore, the coloring is different between them. As described in the foregoing, Japanese Patent Application Publication Hei 3-77066 proposes that combinations of the recording heads for the forward path and the recording heads for the backward path be arranged in the main scan direction so as to accomplish completely the same order of shots by properly switching the combinations. In this embodiment, the prior art is considered, and the advantageous effects thereof are used.

In this embodiment, use is made of switching the combinations of control between the high density portion and the low density portion in the manner described above. As compared with using completely different combinations, the maximum printing frequency of the recording elements can be reduced to one half. In other words, the recordable speed can be doubled.

When the image data are stored at the full address in the memory, and fully solid printing is carried out, the recording is effected by the forward combination in the forward path and by the backward combination in the backward path in the conventional art, and therefore, it is required to provide a printing frequency meeting the allotment of dots to the full address with the recording element. With the conventional system, the maximum density can be allotted to the full address, and therefore, the maximum density is lowered, or otherwise, the printing speed has to be lowered.

According to the system of this embodiment, the printing is effected by the forward and backward combinations of a plurality of the dot diameters only for the low density portion, and for the high density portion, the recording is effected using both of them, and therefore, 1 recording frequency is enough for the full address. In the low density portion, the bi-directional non-uniformity may result due to variation of the recording elements or the like, the image non-uniformity adjacent to maximum density is significantly improved, and the printing speed is significantly enhanced.

Embodiment 4

In further developing the concept of the present invention, the color non-uniformity due to the bi-directional recording can be reduced, even when the symmetrical recording head for the bi-directional print is not used. More particularly, in place of the 1 path bi-directional print, a so-called multi-path print in which printing of 1 pixel area is completed by a plurality of scans is used to accomplish similar effects as the foregoing embodiments.

Figure 12:
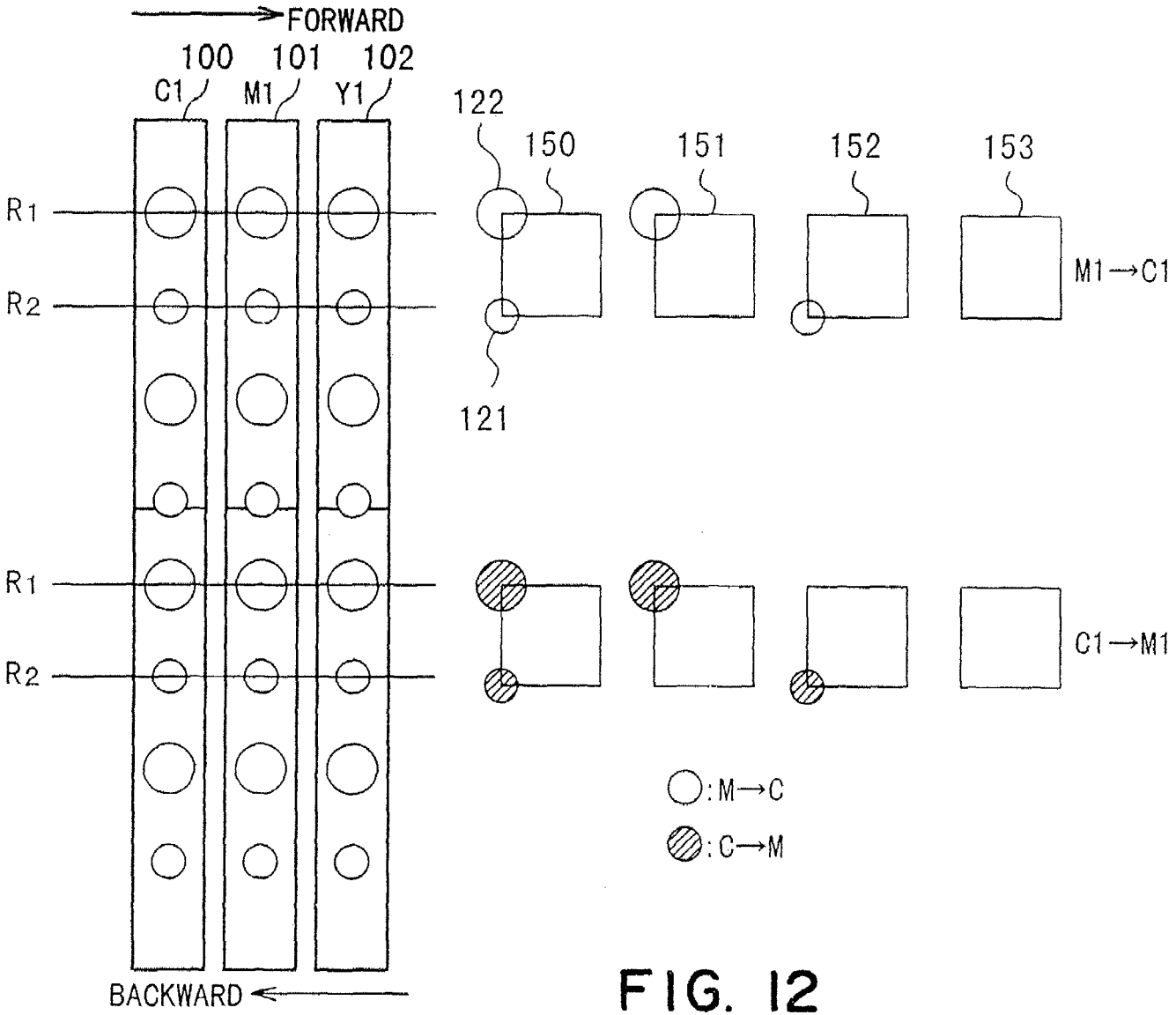
FIG. 12 illustrates production of color non-uniformity in bi-directional printing in prior art.
Figure 13:
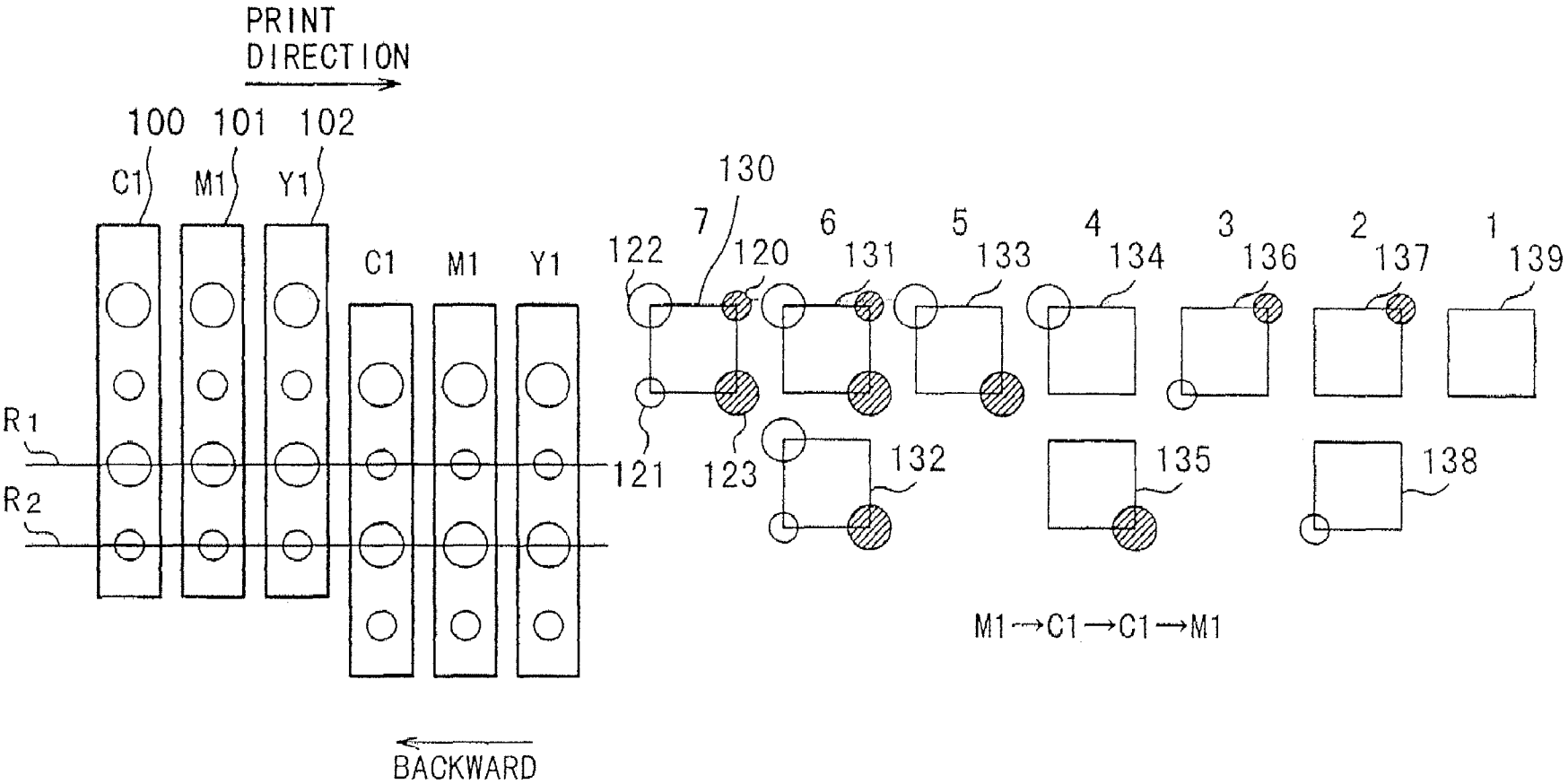
FIG. 13 illustrates a structure of a pixel in a multi-path printing according to Embodiment 4.

The description will be made as to an example in which a recording head having laterally arranged C, M, Y recording elements is used, and blue dots are printed through bi-directional multi-path printing. FIG. 12 shows a conventional example, and FIG. 13 shows Embodiment 3 of the present invention. In the conventional example, the bidirectional printing is simply carried out using large and small nozzles. In this embodiment, the recording head scans the recording material in the forward direction, and thereafter, the recording head is moved relative to the recording material in the sub-scan direction at one half of one recording element pitch (here 2)±1 recording element pitch and three recording element pitch, and then, the recording head scans the recording material, thus effecting the multi-path print.

In the conventional example of FIG. 12, the order of shots of the print data are influenced by the scanning direction with the result of color non-uniformity.

In this embodiment shown in FIG. 13, a pixel is constituted by a pair of the dots for print in the forward path (122 and 121) and the dots for print in the backward path (120 and 123), by which the order of shots is symmetrical for each dot size constituting the pixel, or by which the dots are distributed such that asymmetrical dot arrangements appear substantially equally in the scanning direction when the arrangements are not symmetric, such that uniform coloring is accomplished in the bi-directional printing.

At levels 6 and 3, the relatively smaller dots provided by cyan first and those provided by magenta first are uniformly distributed in the direction of the raster scan. At level 4, the relatively smaller dots provided by cyan first and those provided by magenta first are uniformly distributed in the direction of the raster scan.

As described in the foregoing, control is effected such that occurrence probabilities of the pixels, in which the order of prints for each color is different, are substantially equal in the forward and backward raster scan directions, by which the coloring is substantially uniform macroscopically in the forward and backward directions. Therefore, the occurrences of color non-uniformity attributable to the order of application of the ink in the bi-directional printing can be reduced.

As also described in the foregoing, control is effected such that occurrence probabilities of the pixels, in which the order of prints for each color is different, are substantially equal in the forward and backward raster scan directions and in the column direction, by which the coloring is substantially uniform macroscopically in the forward and backward directions and the column direction. However, the present invention is not limited to this. The occurrence probabilities may be controlled in the predetermined direction in which the color non-uniformity is visually remarkable.

As described in the foregoing, according to the present invention, the occurrence of the color non-uniformity attributable to the order of shots of ink can be reduced even if the bi-directional printing is effected by application of different amounts of ink.

While the invention has been described with reference to the structures disclosed herein, it is not confined to the details set forth and this application is intended to cover such modifications or changes as may come within the purpose of the improvements or the scope of the following claims.

The invention claimed is:

1. A printing apparatus for printing a color image by applying different amounts of different color inks onto a print medium while scanningly moving a recording head bi-directionally, the recording head including recording elements corresponding to the respective different color inks, wherein the recording elements are arranged symmetrically in a scanning direction, said printing apparatus comprising:

a plurality of print buffers corresponding to the symmetrically arranged recording elements; and distributing means for distributing, to the print buffers, print data for different colors constituting a secondary color corresponding to secondary color pixel areas to be printed with the different color inks at least at one ink amount on the basis of image signals corresponding to a color image, the pixel areas being disposed in a raster scan direction, wherein said distributing means distributes the print data corresponding to substantially one-half of the pixel areas to one of said print buffers and distributes the print data corresponding to another part of the pixel areas to another one of said print buffers.

2. An apparatus according to claim 1, wherein said distributing means distributes the print data for the different colors constituting the secondary color to at least one of said print buffers alternately.

3. An apparatus according to claim 1, wherein said distributing means distributes the print data for the different colors constituting the secondary color to at least one of said print buffers at random.

4. An apparatus according to claim 1, wherein said distributing means distributes the print data so as to write the print data in one of said print buffers when a level of the image signal of a secondary color pixel area is low, and said distributing means distributes the print data so as to write the print data in a plurality of said print buffers when a level of the image signal of the secondary color pixel area is high.

* * * * *